US012195996B2

(12) United States Patent
Li et al.

(10) Patent No.: US 12,195,996 B2
(45) Date of Patent: Jan. 14, 2025

(54) INTELLIGENT ANTI-SEISMIC DEVICE FOR SHALLOW FOUNDATION ANCIENT BUILDINGS, AND CONSTRUCTION METHOD THEREFOR

(71) Applicants: China Railway 16th Bureau Group Road & Bridge Engineering Co., Ltd., Beijing (CN); China Railway 16th Bureau Group Co., Ltd., Beijing (CN); WUYI University, Guangdong (CN)

(72) Inventors: Xiang Li, Beijing (CN); Yihong Zhang, Guangdong (CN); Hongli Zheng, Beijing (CN); Tuo Pang, Beijing (CN); Wei Fang, Beijing (CN)

(73) Assignees: China Railway 16th Bureau Group Road & Bridge Engineering Co., Ltd., Beijing (CN); China Railway 16th Bureau Grouia Co., Ltd., Beijing (CN); WUYI UNIVERSITY, Guangdong (CN)

( * ) Notice: Subject to any disclaimer, the term of this patent is extended or adjusted under 35 U.S.C. 154(b) by 356 days.

(21) Appl. No.: 17/915,305

(22) PCT Filed: Sep. 14, 2021

(86) PCT No.: PCT/CN2021/118296
§ 371 (c)(1),
(2) Date: Sep. 28, 2022

(87) PCT Pub. No.: WO2022/160732
PCT Pub. Date: Aug. 4, 2022

(65) Prior Publication Data

US 2023/0145593 A1 May 11, 2023

(30) Foreign Application Priority Data

Feb. 1, 2021 (CN) ..... 202110136726.8

(51) Int. Cl.
*E04H 9/02* (2006.01)
*E02D 17/02* (2006.01)
(Continued)

(52) U.S. Cl.
CPC ..... *E04H 9/027* (2013.01); *E02D 17/02* (2013.01); *E02D 27/12* (2013.01); *E02D 31/08* (2013.01); *E04H 9/022* (2013.01); *E04H 9/0235* (2020.05)

(58) Field of Classification Search
None
See application file for complete search history.

(56) References Cited

U.S. PATENT DOCUMENTS

2023/0145593 A1* 5/2023 Li ..... E04H 9/022 52/167.8

FOREIGN PATENT DOCUMENTS

CN 105715068 A * 6/2016 ..... E04G 23/0229
CN 207944491 U 10/2018
(Continued)

OTHER PUBLICATIONS

International Search Report and Written Opinion for PCT/CN2021/118296.
(Continued)

*Primary Examiner* — Joshua K Ihezie
(74) *Attorney, Agent, or Firm* — Farjami & Farjami LLP

(57) ABSTRACT

Disclosed is an intelligent anti-seismic device for a shallow foundation ancient building, which may include a land, a foundation base and an ancient building body, foundation pit is excavated on a surface of the land, a plurality of piles are arranged on an inner wall of the foundation pit, a foundation side beam is integrally formed by pouring on tops of the plurality of piles, a first earthquake proof mechanism capable of being lifted and lowered is fixed on a top of the
(Continued)

foundation side beam, a well-shaped base is integrally formed on the inner wall of the foundation pit, a second earthquake proof mechanism is fixed on a surface of the well-shaped base, a frame is fixed on both tops of the first earthquake proof mechanism and the second earthquake proof mechanism, a grillage beam is integrally formed on an inner wall of the frame.

8 Claims, 12 Drawing Sheets

(51) Int. Cl.
*E02D 27/12* (2006.01)
*E02D 31/08* (2006.01)

(56) References Cited

FOREIGN PATENT DOCUMENTS

| | | | | |
|---|---|---|---|---|
| CN | 110512665 | A | * | 11/2019 |
| CN | 110512666 | A | | 11/2019 |
| CN | 211973081 | U | | 11/2020 |
| CN | 112709264 | A | | 4/2021 |
| CN | 105863287 | A | | 8/2022 |
| JP | 10-25759 | | | 1/1998 |
| JP | 10-299025 | | | 11/1998 |

OTHER PUBLICATIONS

First Office Action for CN 202110136726.8.
First Search Report for CN 202110136726.8.

* cited by examiner

INTELLIGENT ANTI-SEISMIC DEVICE FOR SHALLOW FOUNDATION ANCIENT BUILDINGS, AND CONSTRUCTION METHOD THEREFOR

This is a U.S. national phase application, which is based on, and claims priority from, PCT application Serial No. PCT/CN2021/118296, filed Sep. 14, 2021, which is based on, and claims priority from Chinese Patent Application Serial No. 202110136726.8, filed Feb. 1, 2021, which are hereby incorporated by reference into the present application.

TECHNICAL FIELD

The present invention relates to the fields of heritage conservation of ancient buildings and intelligent robot technologies, and more particularly, to an intelligent anti-seismic device for a shallow foundation ancient building and a construction method therefor.

BACKGROUND

Ancient buildings refer to civil buildings and public buildings with historical significance constructed before the founding of the People's Republic of China, including buildings constructed in the period of the Republic of China. Some ancient buildings are still retained in many ancient towns and most big cities in China. However, going in for large-scale construction at present, we should look at and protect the ancient buildings and cultural characteristics thereof from a developmental perspective. We should not only preserve the ancient buildings and cultures thereof in the world, but also create modern values of ancient cultural heritages. In some existing ancient buildings, foundations of the ancient buildings are aged and liquefied due to years of disrepair, and the foundations of the ancient buildings are easily damaged in the case of natural disasters such as earthquake, leading to collapse of the ancient buildings. However, existing methods for repairing and earthquake proof of the foundations of the ancient buildings are single and have a poor earthquake proof effect.

Therefore, it is necessary to provide an intelligent anti-seismic device for a shallow foundation ancient building and a construction method therefor to solve the technical problems above.

SUMMARY

In order to address the technical problems above, the present invention provides an intelligent anti-seismic device for a shallow foundation ancient budding and a construction method therefor.

An intelligent anti-seismic device for a shallow foundation ancient building provided by the present invention includes a land, a foundation base and an ancient building body, wherein a foundation pit is excavated on a surface of the land, a plurality of piles are arranged equidistantly on an inner wall of the foundation pit, a foundation side beam is integrally formed by pouring on tops of the plurality of piles, a first earthquake proof mechanisms capable of being lifted and lowered is fixed on a top of the foundation side beam, a well-shaped base is integrally formed on the inner wall of the foundation pit, a second earthquake proof mechanism is fixed on a surface of the well-shaped base, a frame is fixed on both tops of the first earthquake proof mechanism and the second earthquake proof mechanism, a grillage beam is integrally formed on an inner wall of the frame, the foundation base is fixed on a top of the frame, and the ancient building body is fixed on the top of the foundation base; and the first earthquake proof mechanism includes a first pedestal, a first mounting seat, a first rubber seat, a second pedestal, a second rubber seat, a hydraulic cylinder, a jacking block, a through hole and a correction mechanism, the first pedestal is fixed on a top of the foundation side beam, the first mounting seat is fixed on a top of the first pedestal, the first rubber seat is fixed on a top of the first mounting seat, the second pedestal is arranged above the first pedestal and the second pedestal is fixedly connected with the frame, the second rubber seat is fixed on a bottom of the second pedestal and the first rubber seat is matched with the second rubber seat, the hydraulic cylinder is fixed by embedding in a middle of the first mounting seat, the jacking block is fixed on a top of the hydraulic cylinder, the through hole is opened in a middle of the second pedestal and the jacking block passes through the through hole, and the correction mechanism is fixed on the top of the first mounting seat.

Preferably, the second earthquake proof mechanism includes a third pedestal, a second mounting seat, a third rubber seat, a fourth pedestal and a fourth rubber seat, the third pedestal is symmetrically fixed on an upper surface of the well-shaped base and the third pedestal is fixedly connected with the grillage beam, the second mounting seat is fixed on a top of that third pedestal, the third rubber seat is fixed on a top of the second mounting seat, the fourth pedestal is arranged above the third pedestal, and the fourth rubber seat is fixed on a bottom of the fourth pedestal and the third rubber seat is matched with the fourth rubber seat.

Preferably, the correction mechanism includes a fixed shell, a rotating shaft, a gear, a rack and an encoder, the fixed shell is fixed on an upper surface of the first mounting seat, the rotating shaft is rotatably connected with an inner wall of the fixed shell through a bearing, the gear is fixed in a middle of the rotating shaft, the rack is fixed on the bottom of the second pedestal and the gear is meshed with the rack, the encoder is fixed on one side of the fixed shell, and an input end of the encoder is fixedly connected with the rotating shaft.

Preferably, both tops of the first rubber seat and the third rubber seat are set as an arc-shaped recess, both bottoms of the second rubber seat and the fourth rubber seat are set as an arc-shaped bulge, the top of the first rubber seat is meshed with the bottom of the second rubber seat, and the top of the third rubber seat is meshed with the bottom of the fourth rubber seat.

Preferably, limiting enclosures are fixed on both bottoms of the second pedestal and the fourth pedestal, and inner walls of the limiting enclosures are slidably connected with the first mounting seat and the second mounting seat respectively, and rubber rings are fixed on both upper surfaces of the first pedestal and the third pedestal, and the rubber rings are matched with the limiting enclosures.

Preferably, a soil retaining enclosure is poured on an outer side of the foundation side beam, and an outer side of the frame is slidably connected with an inner wall of the soil retaining enclosure.

Preferably, the first rubber seat, the second rubber seat, the third rubber seat, the fourth rubber seat and the rubber ring are formed by embedding and bonding multiple layers of rubber sheets and thin steel sheets.

The present invention further includes a construction method for an intelligent anti-seismic device for a shallow foundation ancient building, wherein the construction method includes steps of:

1) constructing the ancient building on the ground, and when adding earthquake proof to a foundation of the ancient building, excavating a land around a foundation base at a bottom of an ancient building body first, without excavating soil at a bottom of the foundation;
2) driving a pile into a foundation pit excavated, and pouring a foundation side beam on a top of the pile, wherein the foundation side beam is located below a periphery of the foundation base;
3) placing soil below the foundation base into a grillage beam, and pouring a frame on an outer side the grillage beam;
4) fixing a first earthquake proof mechanism on the foundation side beam, and making a hydraulic cylinder and a jacking block on the first earthquake proof mechanism jack up the frame to support the ancient building body and the foundation base;
5) excavating soil at a bottom of the foundation base to form the foundation pit, and then pouring a well-shaped base inside the foundation pit;
6) fixing a second earthquake proof mechanism on a surface of the well-shaped base, and pressing the frame on the first earthquake proof mechanism by lowering the hydraulic cylinder while pressing the grillage beam on the second earthquake proof mechanism, so as to take an earthquake absorption effect; and
7) pouring a soil retaining enclosure on an outer side the foundation side beam, and then backfilling the soil in the foundation pit.

Compared with related art, the intelligent anti-seismic device for the shallow foundation ancient building and the construction method therefor provided by the present invention have the following beneficial effects:

the present invention provides the intelligent anti-seismic device for the shallow foundation ancient building and the construction method therefor:

1. the soil at the bottom of the foundation base is hardened and reinforced through the piles, thereby preventing the soil at the bottom of the foundation base from collapsing, so as to improve an intensity and prevent collapse;
2. earthquake absorption and earthquake proof are carried out on the foundation base through the first earthquake proof mechanism and the second earthquake proof mechanism, thereby reducing an impact of natural disasters such as earthquake on the ancient building body; and
3. a swing amplitude of the ancient building body is detected by the correction mechanism, and jacking correction is assisted by the hydraulic cylinder, thereby preventing the ancient building from falling.

Figure 1:
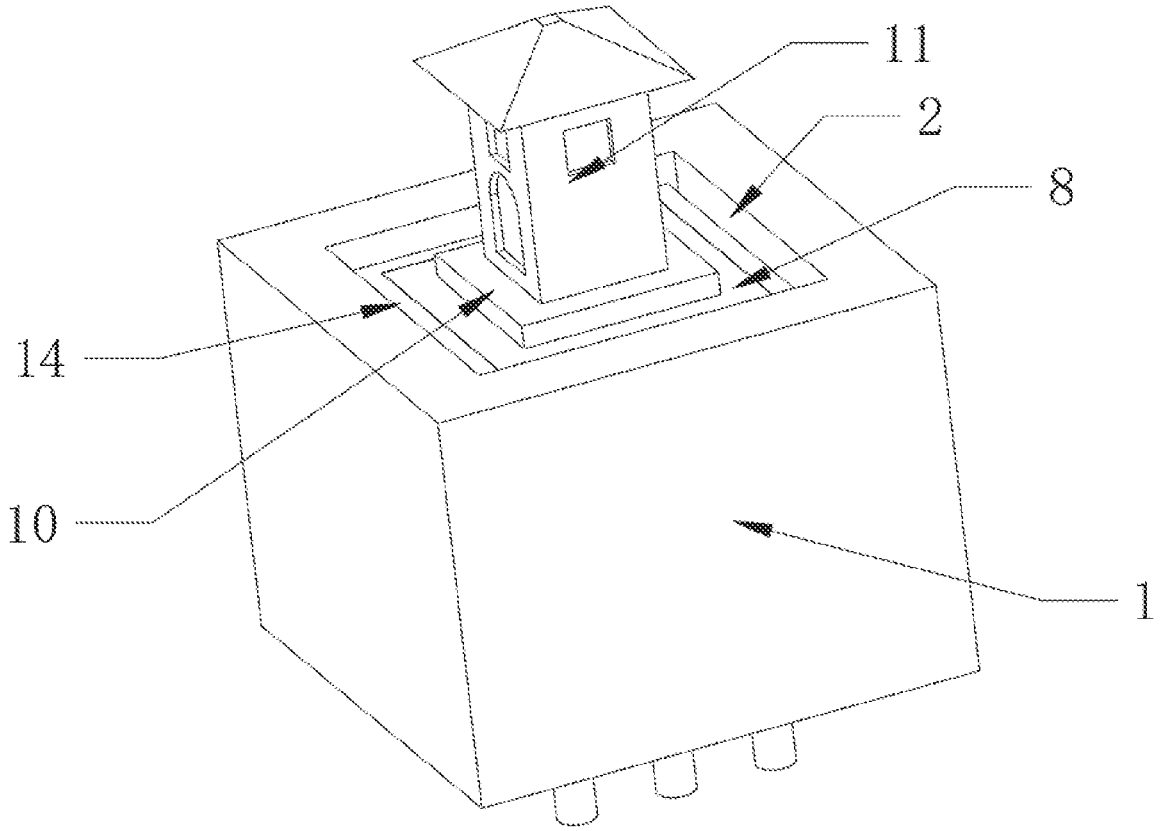
FIG. 1 is a schematic diagram of an overall structure provided by the present invention.

Reference numerals in the drawings: 1 refers to land; 2 refers to foundation pit; 3 refers to pile; 4 refers to foundation side beam; 5 refers to first earthquake proof mechanism; 51 refers to first pedestal; 52 refers to first mounting seat; 53 refers to first rubber seat; 54 refers to second pedestal; 55 refers to second rubber seat; 56 refers to hydraulic cylinder; 57 refers to jacking block; 58 refers to through hole; 59 refers to correction mechanism; 591 refers to fixed shell; 592 refers to rotating shaft, 593 refers to gear; 594 refers to rack; 595 refers to encoder; 6 refers to well-shaped base; 7 refers to second earthquake proof mechanism; 71 refers to third pedestal; 72 refers to second mounting seat; 73 refers to third rubber seat; 74 refers to fourth pedestal; 75 refers to fourth rubber seat; 8 refers to frame; 9 refers to grillage beam; 10 refers to foundation base; 11 refers to ancient building body, 12 refers to limiting enclosure; 13 refers to rubber ring; and 14 refers to soil retaining enclosure.

DETAILED DESCRIPTION

The present invention is further described hereinafter with reference to the drawings and the embodiments.

In an implementing process, as shown in FIG. 1, FIG. 2, FIG. 3, FIG. 4 and FIG. 5, an intelligent anti-seismic device for a shallow foundation ancient building includes a land 1, a foundation base 10 and an ancient building body 11. A foundation pit 2 is excavated on a surface of the land 1, piles 3 are arranged equidistantly on an inner wall of the foundation pit 2, a foundation side beam 4 is integrally formed by pouring on tops of a plurality of piles 3, first earthquake proof mechanisms 5 capable of being lifted and lowered are fixed equidistantly on a top of the foundation side beam 4, a well-shaped base 6 is integrally formed on the inner wall of the foundation pit 2, second earthquake proof mechanisms 7 are fixed equidistantly on a surface of the well-shaped base 6, a frame 8 is fixed on both tops of the first earthquake proof mechanism 5 and the second earthquake proof mechanism 7, a grillage beam 9 is integrally formed on an inner wall of the frame 8, the foundation base 10 is fixed on a top of the frame 8, and the ancient building body 11 is fixed on the top of the foundation base 10. The pile 3, the foundation side beam 4 and the well-shaped base 6 arranged at the bottom of the foundation base 10 can prevent foundation liquefaction caused by earthquake and prevent the ancient building from sinking.

Figure 6:
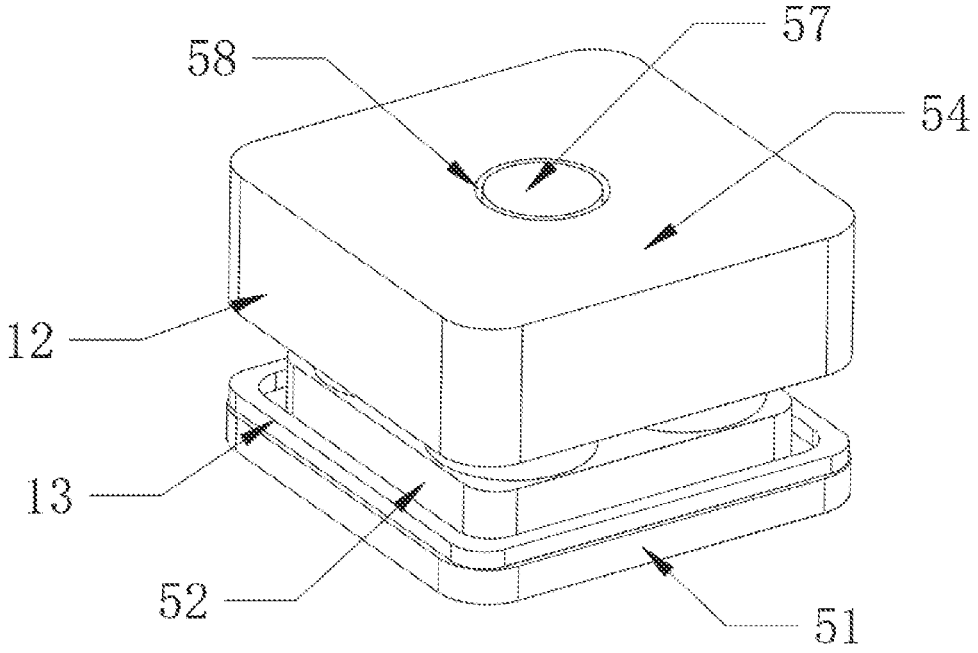
FIG. 6 is a schematic structural diagram of a first earthquake proof mechanism provided by the present invention.
Figure 7:
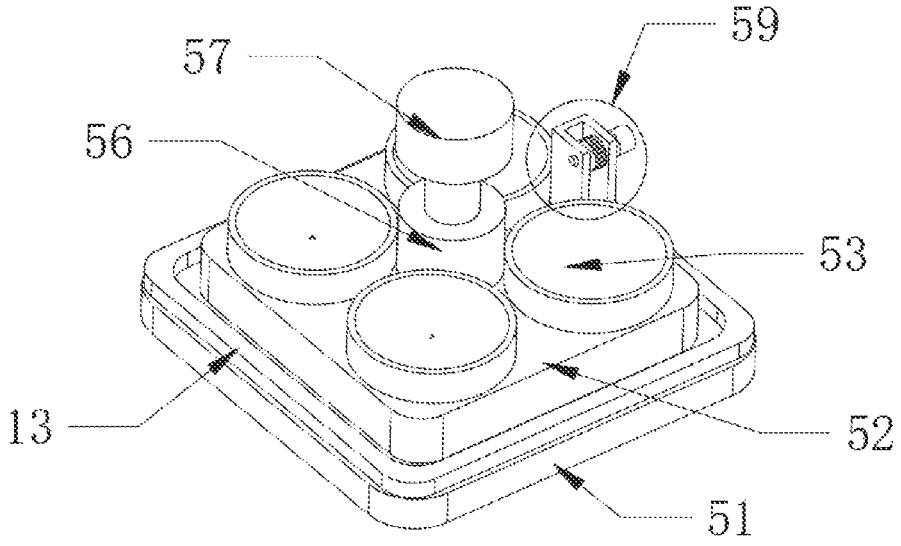
FIG. 7 is a schematic structural diagram of a first rubber seat provided by the present invention.
Figure 8:
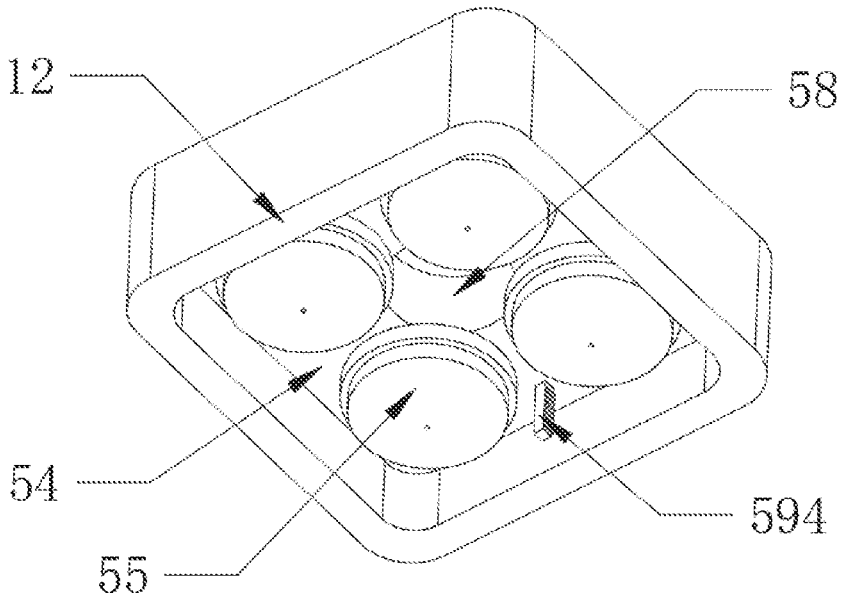
FIG. 8 is a schematic structural diagram of a second rubber seat provided by the present invention.

Referring to FIG. 6, FIG. 7 and FIG. 8, the first earthquake proof mechanism 5 includes a first pedestal 51, a first mounting seat 52, a first rubber seat 53, a second pedestal 54, a second rubber seat 55, a hydraulic cylinder 56, a jacking block 57, a through hole 58 and a correction mechanism 59.

The first pedestal 51 is fixed equidistantly on a top of the foundation side beam 4, the first mounting seat 52 is fixed on a top of the first pedestal 51, the first rubber seat 53 is fixed equidistantly on a top of the first mounting seat 52, the second pedestal 54 is arranged above the first pedestal 51 and the second pedestal 54 is fixedly connected with the frame 8, the second rubber seat 55 is fixed equidistantly on a bottom of the second pedestal 54 and the first rubber seat 53 is matched with the second rubber seat 55, the hydraulic cylinder 56 is fixed by embedding in a middle of the first mounting seat 52, and the jacking block 57 is fixed on a top of the hydraulic cylinder 56. During construction, the frame 8 may be jacked up through the hydraulic cylinder 56, which is convenient for subsequent construction of the well-shaped base 6 and mounting of the second earthquake proof mechanism 7, and during jacking up, the first earthquake proof mechanism 5 and the second earthquake proof mechanism 7 have no earthquake absorption effect. The through hole 58 is opened in a middle of the second pedestal 54 and the jacking block 57 passes through the through hole 58, and the correction mechanism 59 is fixed on the top of the first mounting seat 52.

Figure 9:
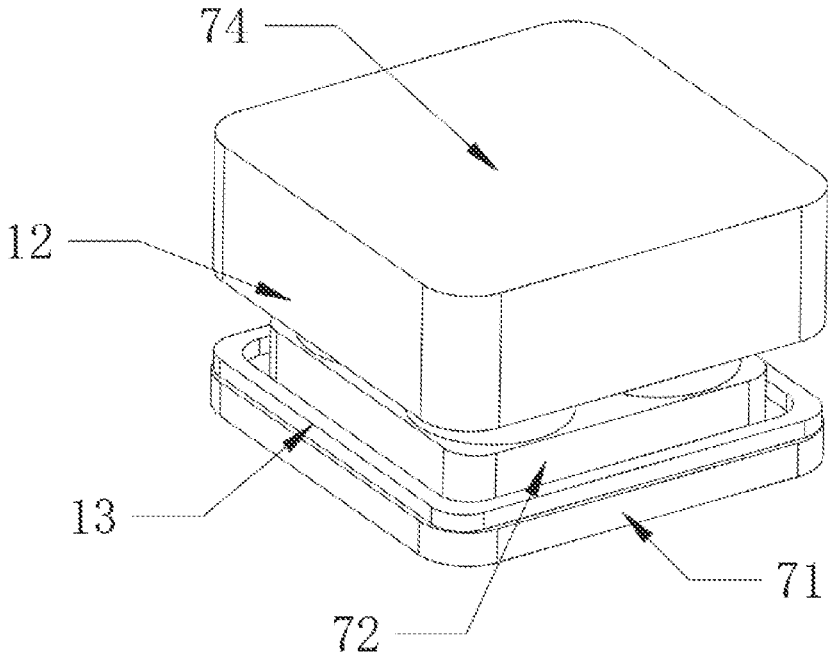
FIG. 9 is a schematic structural diagram of a second earthquake proof mechanism provided by the present invention.
Figure 10:
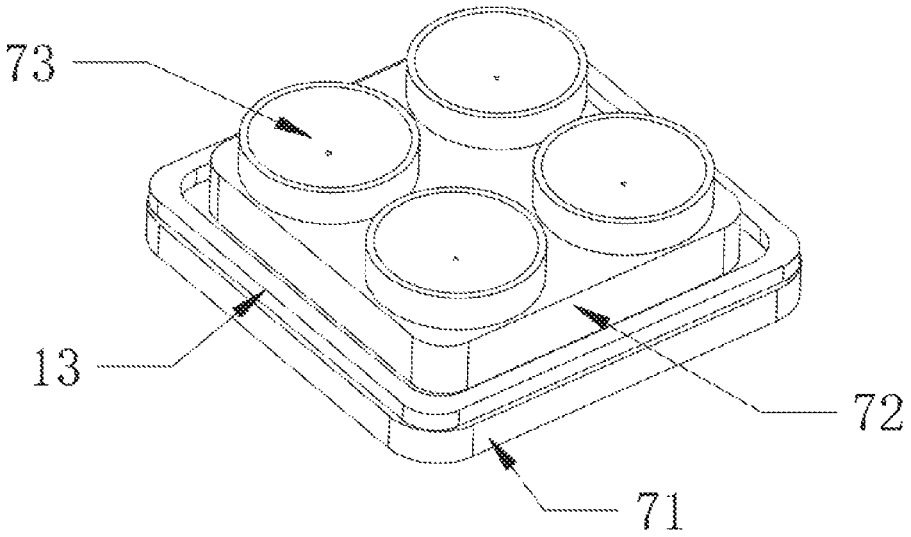
FIG. 10 is a schematic structural diagram of a third rubber seat provided by the present invention.
Figure 11:
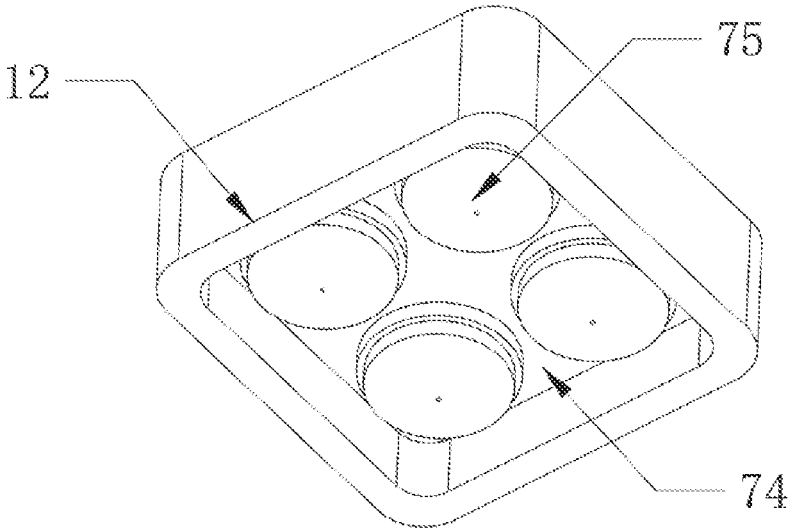
FIG. 11 is a schematic structural diagram of a fourth rubber seat provided by the present invention.

Referring to FIG. 9, FIG. 10 and FIG. 11, the second earthquake proof mechanism 7 includes a third pedestal 71, a second mounting seat 72, a third rubber seat 73, a fourth pedestal 74 and a fourth rubber seat 75. The third pedestal 71 is symmetrically fixed on an upper surface of the well-shaped base 6 and the third pedestal 71 is fixedly connected with the grillage beam 9, the second mounting seat 72 is fixed on a top of that third pedestal 71, the third rubber seat 73 is fixed equidistantly on a top of the second mounting seat 72, the fourth pedestal 74 is arranged above the third pedestal 71, and the fourth rubber seat 75 is fixed equidistantly on a bottom of the fourth pedestal 74 and the third rubber seat 73 is matched with the fourth rubber seat 75. The first rubber seat 53, the second rubber seat 55, the third rubber seat 73, the fourth rubber seat 75 and the rubber ring 13 are formed by embedding and bonding multiple layers of rubber sheets and thin steel sheets, thereby improving a vertical bearing capacity of the first rubber seat 53, the second rubber seat 55, the third rubber seat 73, the fourth rubber seat 75 and the rubber ring 13.

It should be noted that the foundation base 10, the frame 8 and the grillage beam 9 are supported by the first earthquake proof mechanism 5 and the second earthquake proof mechanism 7, and when an earthquake occurs, earthquake absorption is carried out through the first rubber seat 53, the second rubber seat 55, the third rubber seat 73 and the fourth rubber seat 75.

Figure 12:
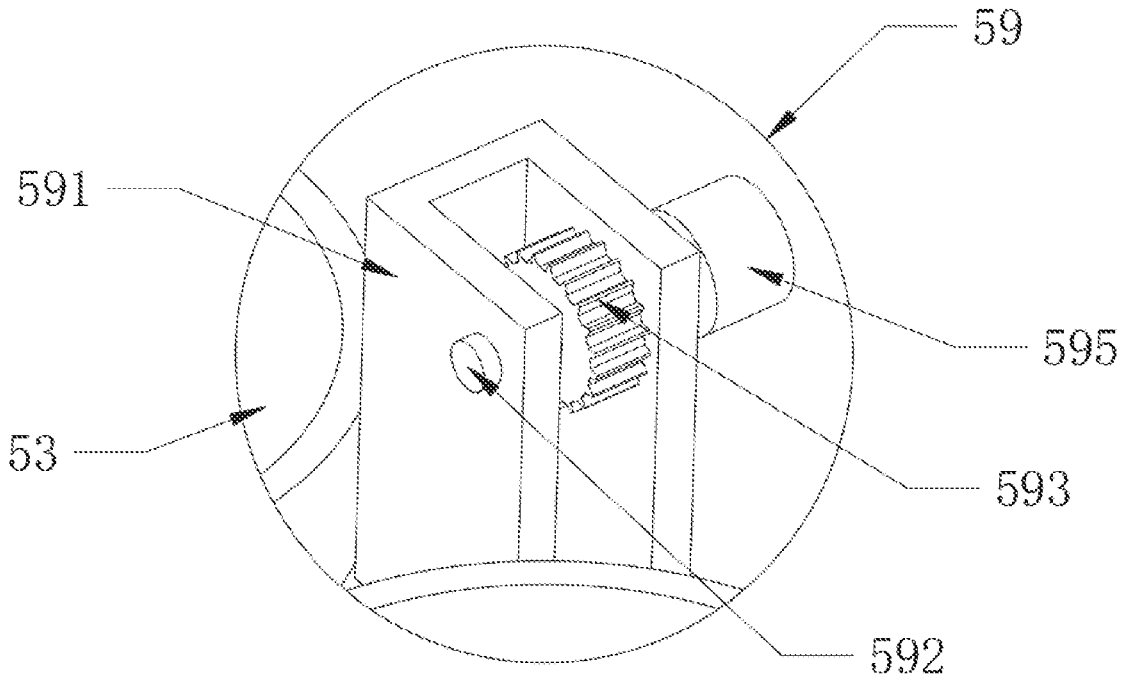
FIG. 12 is a schematic structural diagram of a correction mechanism provided by the present invention.
Figure 13:
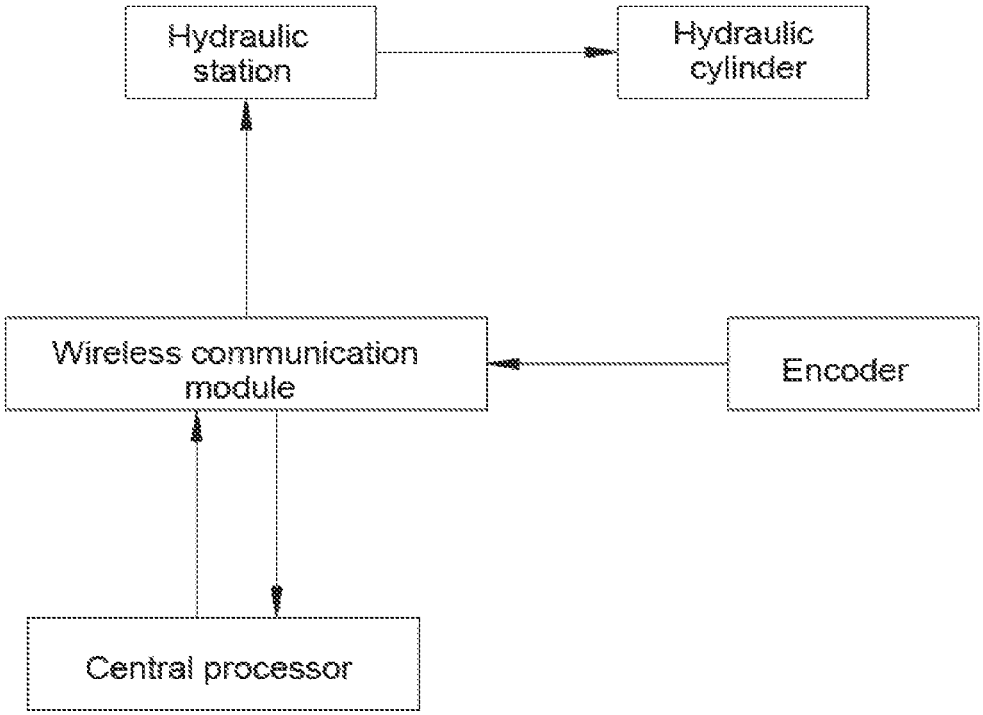
FIG. 13 is a schematic control diagram of an electrical apparatus element provided by the present invention.

Referring to FIG. 8, FIG. 12 and FIG. 13, the correction mechanism 59 includes a fixed shell 591, a rotating shaft 592, a gear 593, a rack 594 and an encoder 595. The fixed shell 591 is fixed on an upper surface of the first mounting seat 52, the rotating shaft 592 is rotatably connected with an inner wall of the fixed shell 591 through a bearing, the gear 593 is fixed in a middle of the rotating shaft 592, the rack 594 is fixed on the bottom of the second pedestal 54 and the gear 593 is meshed with the rack 594, the encoder 595 is fixed on one side of the fixed shell 591, and an input end of the encoder 595 is fixedly connected with the rotating shaft 592. When the first earthquake proof mechanism 5 is operated, the frame 8 drives the second pedestal 54 to press down, so that the second pedestal 54 sinks and then the rack 594 moves downwardly, and the rack 594 drives the gear 593 to rotate and then the gear 593 drives the encoder 595 to rotate. A sinking magnitude of the second pedestal 54 is measured through a rotation angle of the encoder 595, so that when the sinking magnitude is excessively large and exceeds a safe range, the jacking block 57 is driven by jacking up through the hydraulic cylinder 56 to jack up the second pedestal 54, and then a corner with a larger sinking magnitude is supported, thereby reducing a swing amplitude and taking an earthquake proof effect. In specific application, we can set a value of the sinking magnitude, so that operation of each mechanism may make a running action of corresponding precision according to actual needs. The hydraulic cylinder 56 is driven by a hydraulic station, the encoder 595 is wirelessly connected with a central processor through a wireless communication module, and the central processor is wirelessly connected with the hydraulic station through the wireless communication module, so as to control operation of the hydraulic cylinder 56. Circuits and controls involved in the present invention are existing technologies, which will not be repeated herein.

Referring to FIG. 7, FIG. 8. FIG. 10 and FIG. 11, both tops of the first rubber seat 53 and the third rubber seat 73 are set as an arc-shaped recess, both bottoms of the second rubber seat 55 and the fourth rubber seat 75 are set as an arc-shaped bulge, the top of the first rubber seat 53 is meshed with the bottom of the second rubber seat 55, and the top of the third rubber seat 73 is meshed with the bottom of the fourth rubber seat 75. There is a certain gap, so that the frame 8 is capable of swinging within a certain range.

Referring to FIG. 7, FIG. 8, FIG. 10 and FIG. 11, limiting enclosures 12 are fixed on both bottoms of the second pedestal 54 and the fourth pedestal 74, and inner walls of the limiting enclosures 12 are slidably connected with the first mounting seat 52 and the second mounting seat 72 respectively. Rubber rings 13 are fixed on both upper surfaces of the first pedestal 51 and the third pedestal 71, and the rubber rings 13 are matched with the limiting enclosures 12, which is convenient for earthquake absorption of the limiting enclosures 12, thereby improving an overall earthquake absorption effect.

Figure 2:
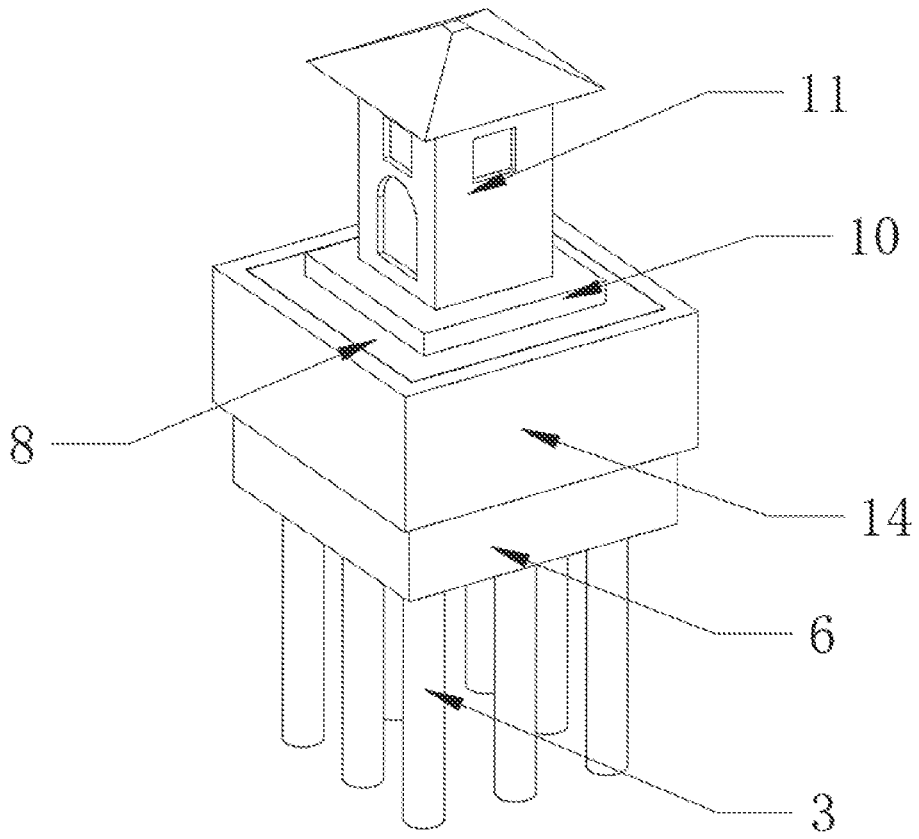
FIG. 2 is a schematic structural diagram of a soil retaining enclosure provided by the present invention.
Figure 3:
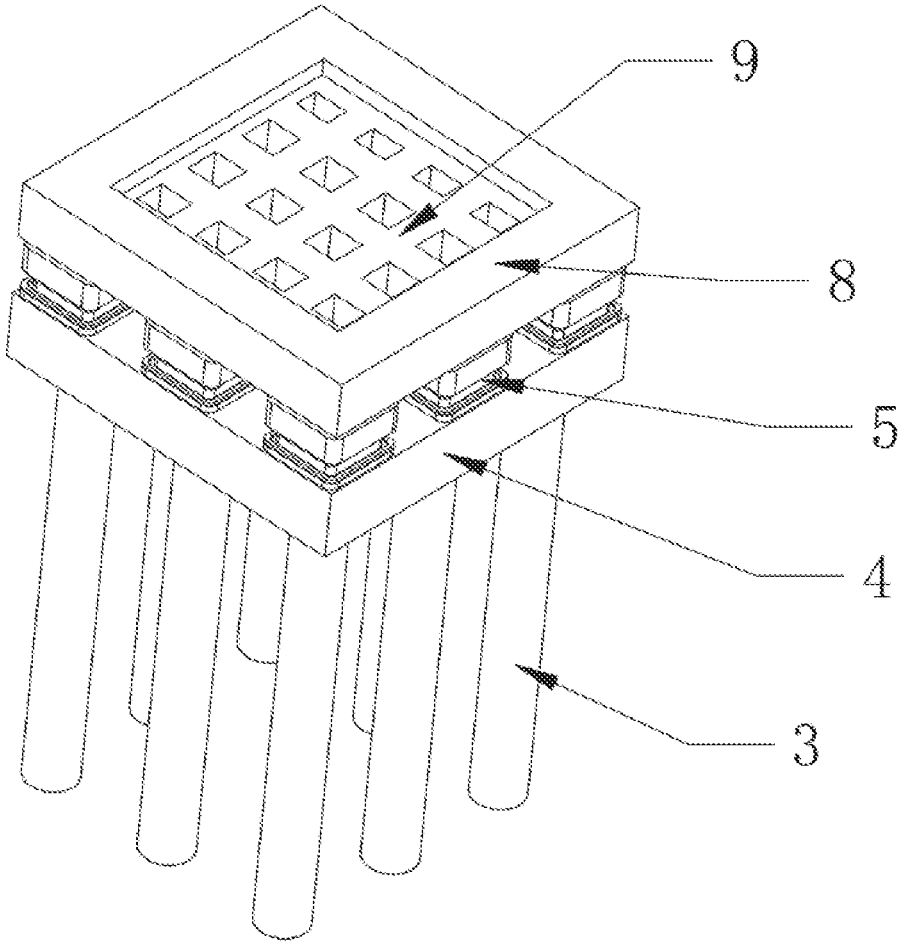
FIG. 3 is a schematic structural diagram of a grillage beam provided by the present invention.
Figure 4:
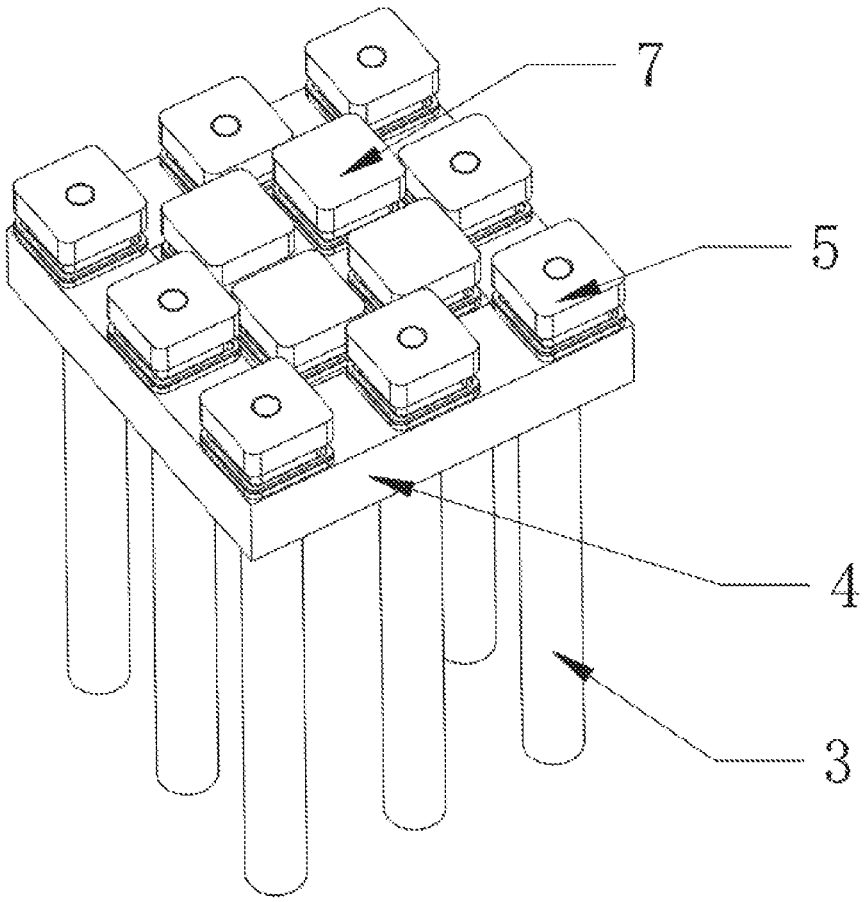
FIG. 4 is a schematic structural diagram of a foundation side beam provided by the present invention.
Figure 5:
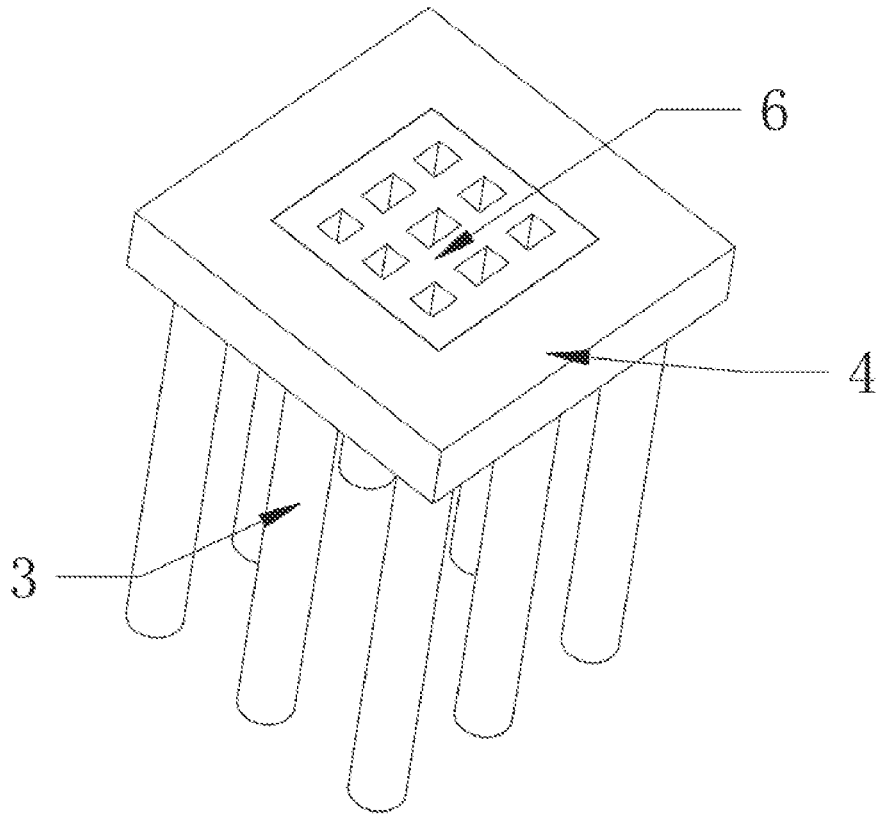
FIG. 5 is a schematic structural diagram of a well-shaped base provided by the present invention.

Referring to FIG. 2, a soil retaining enclosure 14 is poured on an outer side of the foundation side beam 4, and an outer side of the frame 8 is slidably connected with an inner of the soil retaining enclosure 14, which prevents backfilled soil from entering the first earthquake proof mechanism 5 and the second earthquake proof mechanism 7.

The present invention further includes a construction method for an intelligent anti-seismic device for a shallow foundation ancient building, wherein the construction method includes steps of:

1) constructing the ancient building on the ground, and when adding earthquake proof to a foundation of the ancient building, excavating a land 1 around a foundation base 10 at a bottom of an ancient building body 11 first, without excavating soil at a bottom of the foundation;
2) driving a pile 3 into a foundation pit 2 excavated, and pouring a foundation side beam 4 on a top of the pile 3, wherein the foundation side beam 4 is located below a periphery of the foundation base 10;
3) placing soil below the foundation base 10 into a grillage beam 9, and pouring a frame 8 on an outer side the grillage beam 9;
4) fixing a first earthquake proof mechanism 5 equidistantly on the foundation side beam 4, and making a hydraulic cylinder 56 and a jacking block 57 on the first earthquake proof mechanism 5 jack up the frame 8 to support the ancient building body 11 and the foundation base 10;

5) excavating soil at a bottom of the foundation base 10 to form the foundation pit 2, and then pouring a well-shaped base 6 inside the foundation pit 2;

6) fixing a second earthquake proof mechanism 7 on a surface of the well-shaped base 6, and pressing the frame 8 on the first earthquake proof mechanism 5 by lowering the hydraulic cylinder 56 while pressing the grillage beam 9 on the second earthquake proof mechanism 7, so as to take an earthquake absorption effect; and 7) pouring a soil retaining enclosure 14 on an outer side the foundation side beam 4, and then backfilling the soil in the foundation pit 2. Corresponding protective measures should be taken in all the above-mentioned foundation pit excavation, drilling, pouring and other related single projects during construction in accordance with relevant construction codes and industry standards of architectural engineering. The earthquake proof structure and the construction method of the present invention are mainly suitable for ancient buildings with a small area. Specific construction projects should all be executed after strict evaluation.

Operating Principle:

When in use, the foundation base 10, the frame 8 and the grillage beam 9 are supported by the first earthquake proof mechanism 5 and the second earthquake proof mechanism 7. When an earthquake occurs, earthquake absorption is carried out through the first rubber seat 53, the second rubber seat 55, the third rubber seat 73 and the fourth rubber seat 75. Moreover, when the first earthquake proof mechanism 5 is operated, the frame 8 drives the second pedestal 54 to press down, so that the second pedestal 54 sinks and then the rack 594 moves downwardly, and the rack 594 drives the gear 593 to rotate and then the gear 593 drives the encoder 595 to rotate. The sinking magnitude of the second pedestal 54 is measured through the rotation angle of the encoder 595, so that when the sinking magnitude is excessively large and exceeds the safe range, the jacking block 57 is driven by jacking up through the hydraulic cylinder 56 to jack up the second pedestal 54, and then the corner with the larger sinking magnitude is supported, thereby reducing the swing amplitude and taking the earthquake proof effect. Under normal circumstances, the earthquake proof effect may be realized through the first rubber seat 53, the second rubber seat 55, the third rubber seat 73 and the fourth rubber seat 75. The pile 3, the foundation side beam 4 and the well-shaped base 6 arranged at the bottom of the foundation base 10 can prevent the foundation liquefaction caused by the earthquake and prevent the ancient building from sinking.

The above is only the embodiments of the present invention, and is not intended to limit the patent scope of the present invention. Any equivalent structures or equivalent process transformations made by utilizing the contents of the specification and the drawings of the present invention, or directly or indirectly applied in other related technical fields are equally included in the scope of protection of the patent of the present invention.

What is claimed is:

1. An intelligent anti-seismic device for a shallow foundation ancient building, comprising a land, a foundation base and a body of the ancient building, wherein a foundation pit is excavated on a surface of the land, a plurality of piles are arranged on an inner wall of the foundation pit, a foundation side beam is integrally formed by pouring on tops of the plurality of piles, a first earthquake proof mechanism capable of being lifted and lowered is fixed on a top of the foundation side beam, a well-shaped base is integrally formed on the inner wall of the foundation pit, a second earthquake proof mechanism is fixed on a surface of the well-shaped base, a frame is fixed on both tops of the first earthquake proof mechanism and the second earthquake proof mechanism, a grillage beam is integrally formed on an inner wall of the frame, the foundation base is fixed on a top of the frame, and the body of the ancient building is fixed on the top of the foundation base; and the first earthquake proof mechanism comprises a first pedestal, a first mounting seat, a first rubber seat, a second pedestal, a second rubber seat, a hydraulic cylinder, a jacking block, a through hole and a correction mechanism, the first pedestal is fixed on the top of the foundation side beam, the first mounting seat is fixed on a top of the first pedestal, the first rubber seat is fixed on a top of the first mounting seat, the second pedestal is arranged above the first pedestal and the second pedestal is fixedly connected with the frame, the second rubber seat is fixed on a bottom of the second pedestal and the first rubber seat is matched with the second rubber seat, the hydraulic cylinder is fixed by embedding in a middle of the first mounting seat, the jacking block is fixed on a top of the hydraulic cylinder, the through hole is opened in a middle of the second pedestal and the jacking block passes through the through hole, and the correction mechanism is fixed on the top of the first mounting seat.

2. The intelligent anti-seismic device for the shallow foundation ancient building of claim 1, wherein the second earthquake proof mechanism comprises a third pedestal, a second mounting seat, a third rubber seat, a fourth pedestal and a fourth rubber seat, the third pedestal is symmetrically fixed on an upper surface of the well-shaped base and the third pedestal is fixedly connected with the grillage beam, the second mounting seat is fixed on a top of the third pedestal, the third rubber seat is fixed on a top of the second mounting seat, the fourth pedestal is arranged above the third pedestal, and the fourth rubber seat is fixed on a bottom of the fourth pedestal and the third rubber seat is matched with the fourth rubber seat.

3. The intelligent anti-seismic device for the shallow foundation ancient building of claim 2, wherein the correction mechanism comprises a fixed shell, a rotating shaft, a gear, a rack and an encoder, the fixed shell is fixed on an upper surface of the first mounting seat, the rotating shaft is rotatably connected with an inner wall of the fixed shell through a bearing, the gear is fixed in a middle of the rotating shaft, the rack is fixed on the bottom of the second pedestal and the gear is meshed with the rack, the encoder is fixed on one side of the fixed shell, and an input end of the encoder is fixedly connected with the rotating shaft.

4. The intelligent anti-seismic device for the shallow foundation ancient building of claim 2, wherein both tops of the first rubber seat and the third rubber seat are set as an arc-shaped recess, both bottoms of the second rubber seat and the fourth rubber seat are set as an arc-shaped bulge, the top of the first rubber seat is meshed with the bottom of the second rubber seat, and the top of the third rubber seat is meshed with the bottom of the fourth rubber seat.

5. The intelligent anti-seismic device for the shallow foundation ancient building of claim 3, wherein limiting enclosures are fixed on both bottoms of the second pedestal and the fourth pedestal, and inner walls of the limiting enclosures are slidably connected with the first mounting seat and the second mounting seat respectively, and rubber rings are fixed on both upper surfaces of the first pedestal and the third pedestal, and the rubber rings are matched with the limiting enclosures.

6. The intelligent anti-seismic device for the shallow foundation ancient building of claim 1, wherein a soil retaining enclosure is poured on an outer side of the foundation side beam, and an outer side of the frame is slidably connected with an inner wall of the soil retaining enclosure.

7. The intelligent anti-seismic device for the shallow foundation ancient building of claim 3, wherein the first rubber seat, the second rubber seat, the third rubber seat, the fourth rubber seat and the rubber ring are formed by embedding and bonding multiple layers of rubber sheets and thin steel sheets.

8. A construction method for an intelligent anti-seismic device for a shallow foundation ancient building, wherein the construction method comprises;

1) constructing the ancient building on the ground, and when adding earthquake proof to a foundation of the ancient building, excavating a land around a foundation base at a bottom of a body of the ancient building first, without excavating soil at a bottom of the foundation;
2) driving a pile into a foundation pit excavated, and pouring a foundation side beam on a top of the pile, wherein the foundation side beam is located below a periphery of the foundation base;
3) placing soil below the foundation base into a grillage beam, and pouring a frame on an outer side the grillage beam;
4) fixing a first earthquake proof mechanism on the foundation side beam, and making a hydraulic cylinder and a jacking block on the first earthquake proof mechanism jack up the frame to support the body of the ancient building and the foundation base;
5) excavating soil at a bottom of the foundation base to form the foundation pit, and then pouring a well-shaped base inside the foundation pit;
6) fixing a second earthquake proof mechanism on a surface of the well-shaped base, and pressing the frame on the first earthquake proof mechanism by lowering the hydraulic cylinder while pressing the grillage beam on the second earthquake proof mechanism, so as to take an earthquake absorption effect; and
7) Pouring a soil retaining enclosure on an outer side the foundation side beam, and then backfilling the soil in the foundation pit.

* * * * *